United States Patent [19]

Dzierson et al.

[11] 4,414,692

[45] Nov. 15, 1983

[54] DRINKING GLOVE

[75] Inventors: Mark A. Dzierson; William V. Dzierson, Sr., both of Johnstown, N.Y.

[73] Assignee: Elmer Little & Sons, Inc., Johnstown, N.Y.

[21] Appl. No.: 385,806

[22] Filed: Jun. 7, 1982

[51] Int. Cl.[3] ..... A41D 19/00

[52] U.S. Cl. ..... 2/160; 2/DIG. 6

[58] Field of Search ..... 2/DIG. 6, 158, 159, 2/160, 161 R, 161 A; D7/1, 6, 45, 70; D2/360, 364, 368; D24/48

[56] References Cited

U.S. PATENT DOCUMENTS

| | | | |
|---|---|---|---|
| 2,035,384 | 3/1936 | Hinchliff | D7/45 X |
| 2,735,108 | 2/1956 | Cremer | 2/158 |
| 2,902,693 | 9/1959 | Wells | 2/158 |
| 3,368,811 | 2/1968 | Finney | 2/DIG. 6 |
| 4,247,097 | 1/1981 | Schwartz | D2/368 X |
| 4,326,706 | 4/1982 | Guthrie et al. | 2/160 X |

*Primary Examiner*—Louis Rimrodt

*Attorney, Agent, or Firm*—Hubbell, Cohen, Stiefel & Gross

[57] ABSTRACT

A drinking glove (10) for facilitating handling of a drinking vessel (52) includes a glove portion (12) and a pocket portion (14) secured to the palm (22) of the glove portion (12), the pocket portion (14) defining a volume (16) dimensioned to receive a drinking vessel (52).

2 Claims, 2 Drawing Figures

DRINKING GLOVE

TECHNICAL FIELD

This invention relates to an improved glove which is adapted to facilitate handling of a drinking vessel.

BACKGROUND ART

Handling of a drinking vessel, such as a glass, generally requires that the user curl his or her fingers about the glass. When contents of the glass are very hot or very cold, handling of the glass can be uncomfortable, thereby requiring that the glass be put down at regular intervals. Moreover, because the glass is exposed to ambient conditions, its contents may cool (in the case of a hot drink) or warm (in the case of a cold drink) more rapidly than desired.

The prior art, such as Cooper, U.S. Pat. No. 786,006 issued Mar. 28, 1905, Begg, U.S. Pat. No. 463,290 issued Nov. 17, 1891, and Hunter, U.S. Pat. No. 1,090,826 issued March 17, 1914, discloses gloves having pockets stitched or formed therein for holding such small items as change or tickets. However, applicant is unaware of any prior art gloves which include structure adapted to support a drinking vessel.

DISCLOSURE OF THE INVENTION

The present invention is an improved glove which facilitates handling of a drinking vessel. The inventive drinking glove comprises a glove portion adapted to fit about a hand, and a pocket portion secured to the palm of the glove portion, the pocket portion defining a volume dimensioned to receive a drinking vessel, the pocket portion having an opening at the top thereof for accommodating insertion and removal of the drinking vessel.

More particularly, the pocket portion is releasably secured to the palm of the glove portion, and the pocket portion defines a generally cylindrical volume for holding the drinking vessel. As used herein, the term glove portion is intended to include gloves, mittens, and similar hand coverings.

Illustratively, the pocket portion is releasably secured to the palm of the glove portion by employing a hook and pile type fastener of the type sold under the trademark Velcro. Alternatively, one or more snaps may be used in lieu of or in addition to the hook and pile fastener. The size of the cylindrical volume defined by the pocket portion is preferably adjustable whereby the pocket portion can accommodate drinking vessels of various sizes.

To enable the glove to be used by persons having hands of various sizes, the glove portion is preferably without fingers. That is, the glove portion extends from the wrist to just beyond the knuckles, such that in use the user's fingers extend outside the glove. Also, the wrist section of the improved glove may advantageously include means, such as a pair of releasably joined flaps, for adjusting the size of the wrist opening, thereby further enabling use with different hand sizes.

When a drinking vessel is placed in the pocket portion of the improved glove, the vessel may be held without direct contact between the user's fingers and the vessel. This eliminates the uncomfortable feeling that usually accompanies the handling of a vessel whose contents are very hot or very cold. Moreover, the pocket, which encloses the lower portion of the drinking vessel, serves to insulate the vessel, thereby slowing the speed with which the vessel's contents would otherwise return to ambient temperature. Consequently, the vessels contents remain hotter (or colder) for a longer period than usual.

BRIEF DESCRIPTION OF THE DRAWINGS

In the drawings, wherein like numerals represent like parts.

For purposes of clarity, the drawings have not been drawn to scale.

BEST MODE FOR CARRYING OUT THE INVENTION

Figure 1:
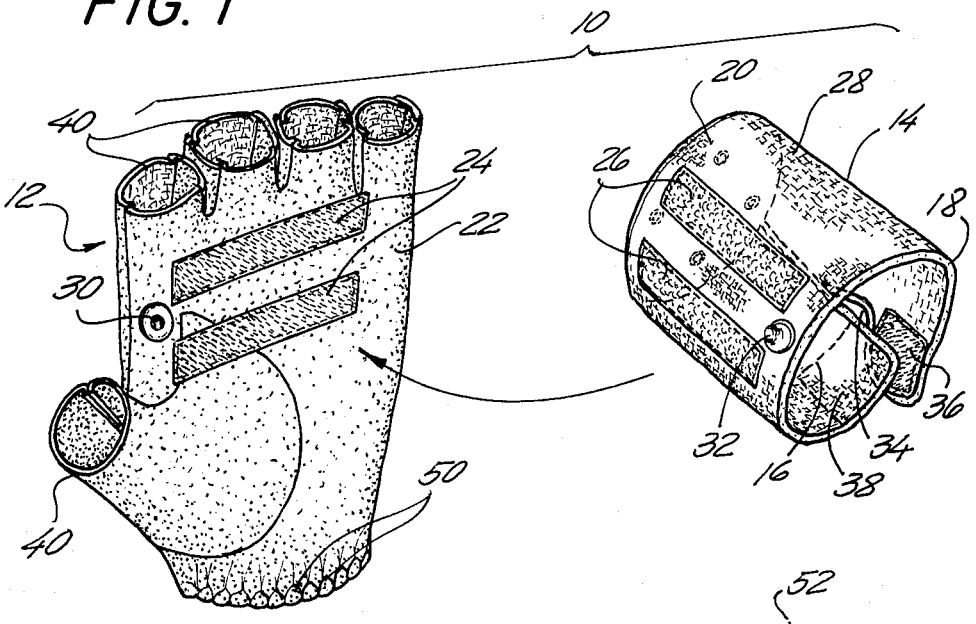
FIG. 1 is a perspective view of the preferred drinking glove of the present invention showing the glove and pocket portions separated.

Referring now to the drawings, the improved drinking glove in accordance with the present invention is generally designated by the reference numeral 10. As best shown in FIG. 1, the drinking glove 10 includes a glove portion 12 and a pocket portion 14 defining a generally cylindrical volume 16 open at the top 18 and closed at the bottom 20. Glove portion 12 and pocket portion 14 are preferably, although not necessarily, comprised of a flexible material. For example, canvas, terrycloth or a combination of such materials may be employed.

As presently preferred and shown, means are provided for releasably securing the pocket portion 14 to the palm 22 of the glove portion 12. This may be accomplished by employing a hook and pile type fastener of the type sold under the trademark Velcro. As shown, strips 24 of the hook material are secured on the palm 22 of the glove portion 12, and corresponding strips 26 of the pile material are secured on the cylindrical wall 28 of the pocket portion 14. When the pocket portion 14 is secured to the glove portion 12, the drinking glove 10 has the appearance illustrated in FIG. 2. Desirably, although not necessarily, complementary snap portions 30 and 32 are secured, respectively, at the upper end of palm 22 between strips 24 and at the upper end of cylindrical wall 28 between the strips 26. The reason for this will be more fully apparent hereinafter.

To enable pocket portion 14 to hold drinking vessels having a range of sizes, the size of the enclosed volume 16 is preferably adjustable. To this end, and as best shown in FIG. 1, a generally axially extending slit 34 is provided in the side wall 28 of the pocket portion 14. A hook and pile type fastener of the type heretofore described may then be used to adjust the extent of overlap between the portions of the side walls 28 on either side of the slit 34, thereby adjusting the diameter of the cylindrical volume 16. The hook and pile type fastener is preferably disposed at the upper end 18 of the glove portion 14, and may comprise a patch 36 of hook material on the inside surface of the wall 28 on one side of the slit 34 and a corresponding patch 38 of pile material on the outside surface of the wall 28 on the other side of the slit 34.

It is desirable that the glove 12 be designed to fit persons having a range of different sized hands. To this end, the glove portion 12 preferably has shortened finger sections 40 such that the fingers 42 of the user extend outside the glove portion 12 during use (FIG. 2).

As a result, the fact that different users have different finger sizes does not require a range of glove sizes. For the same reason, and as best shown in FIG. 2, the diameter of the wrist section 44 of the glove portion 12 is also adjustable. As preferred and shown, the back of the wrist section 44 is comprised of a pair of flaps 46. Means, such as corresponding patches 48 of a hook and pile type fastener of the type heretofore described, are provided on confronting surfaces of the flaps 46. Consequently, the degree to which the flaps overlap may be adjusted, thereby effecting adjustment of the diameter of the wrist section 44. The diameter of the wrist section 44 is preferably further adjustable by rendering the front of the wrist section stretchable. This may be accomplished by disposing an elastic band (not shown) inside the wrist section 44 and by providing pleats 50 in the wrist section 44 to accommodate stretching.

Figure 2:
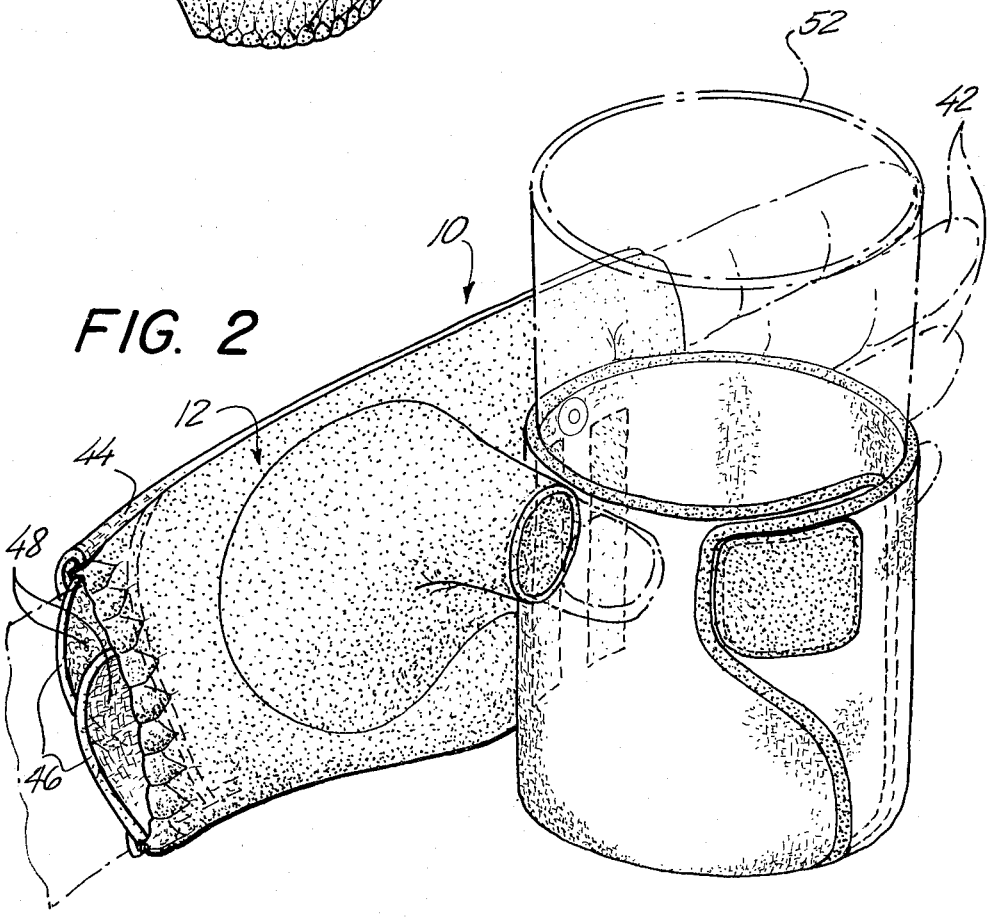
FIG. 2 is another perspective view of the preferred drinking glove, but showing the glove as it appears during use.

In use, and as best shown in FIG. 2, a drinking vessel 52 is disposed in the pocket portion 14 such that the bottom of the drinking vessel sits on the bottom wall 20. Either prior or subsequent thereto, the pocket portion 14 is secured to the glove portion 12 by strips 24, 26 and snap portions 30, 32. It will be apparent from FIG. 2 that the attachment effected by the snap portions 30, 32 retains the top of the pocket portion 14 adjacent the palm 22, thereby preventing the weight of the filled vessel from tipping the vessel away from the palm with a resultant possibility of spillage.

As shown in FIG. 2, when the drinking glove 10 is in use there is no direct contact between the user's fingers 42 and the vessel 52. Consequently, the glove 10 is ideally suited for handling vessels 52 whose contents are very hot or very cold. It will also be apparent from FIG. 2 that the pocket portion 14 serves to insulate at least the lower portion of the vessel 52, thereby slowing the rate at which the contents of vessel 52 return to ambient temperature.

While I have herein shown and described the preferred embodiment of a drinking glove in accordance with the present invention, it will be apparent to those skilled in the art that numerous changes and modifications may be made therein without departing from the spirit and scope of the invention. Accordingly, the above description should be construed as illustrative and not in a limiting sense, the scope of the invention being defined by the following claims.

We claim:

1. A drinking glove for facilitating handling of a drinking vessel comprising:

a glove portion adapted to fit about a hand;

a pocket portion defining a volume dimensioned to receive a drinking vessel, said pocket portion comprising a generally cylindrical member including a generally cylindrical side wall and a substantially continuous bottom wall, said cylindrical member being open at the top for defining an opening in said pocket portion for accommodating insertion and removal of said drinking vessel;

means for releasably securing said pocket portion to said glove portion;

means for retaining the upper end of said pocket portion in close confronting relation with the palm of said glove portion; and means for adjusting the volume enclosed by said pocket portion comprising a generally axial longitudinally extending slit in said side wall, and means for releasably joining the portions of said side wall on either side of said slit and for adjusting the extent of overlap between said portions when joined.

2. The drinking glove of claim 1, further comprising second means for adjusting the size of the opening for the wrist in said glove portion, and wherein the glove portion has shortened, open-ended fingers.

* * * * *